US009121210B2

(12) United States Patent
Rioja Calvo

(10) Patent No.: US 9,121,210 B2
(45) Date of Patent: Sep. 1, 2015

(54) SELF-CLOSURE DEVICE FOR SLIDING MOBILE PARTS

(71) Applicant: INDUSTRIAS AUXILIARES, S.A. (INDAUX), Getaria (Guipuzcoa) (ES)

(72) Inventor: Miguel Angel Rioja Calvo, Zarautz (ES)

(73) Assignee: INDUSTRIAS AUXILIARES, S.A. (INDAUX, S.A.), Getaria (Guipuzcoa) (ES)

( * ) Notice: Subject to any disclaimer, the term of this patent is extended or adjusted under 35 U.S.C. 154(b) by 0 days.

(21) Appl. No.: 14/095,585

(22) Filed: Dec. 3, 2013

(65) Prior Publication Data

US 2014/0189979 A1 Jul. 10, 2014

(30) Foreign Application Priority Data

Jan. 8, 2013 (ES) ..... 201330007

(51) Int. Cl.
*E05F 1/16* (2006.01)
*A47B 88/04* (2006.01)

(52) U.S. Cl.
CPC ..... *E05F 1/16* (2013.01); *A47B 88/047* (2013.01); *A47B 2210/0094* (2013.01); *Y10T 16/585* (2015.01); *Y10T 16/593* (2015.01)

(58) Field of Classification Search
CPC ..... A47B 88/047; A47B 88/0481; A47B 2008/0474; A47B 2210/0094; E06B 3/4636; E05F 1/16; E05F 5/003; E05F 1/08; Y10T 16/287; Y10T 16/299; Y10T 16/56; Y10T 16/568; Y10T 16/585; Y10T 16/593
USPC ..... 16/49, 63, 71–72, 78, 82, 85, 348, 357, 16/DIG. 10, 65, 80; 312/319.1, 333; 49/414, 421
See application file for complete search history.

(56) References Cited

U.S. PATENT DOCUMENTS

| | | | | |
|---|---|---|---|---|
| 6,848,759 | B2 * | 2/2005 | Doornbos et al. | 312/319.1 |
| 7,537,296 | B2 * | 5/2009 | Leon et al. | 312/333 |
| 8,151,413 | B2 * | 4/2012 | Iwaki | 16/96 R |
| 8,172,345 | B2 * | 5/2012 | Liang et al. | 312/333 |
| 8,205,951 | B2 * | 6/2012 | Boks | 312/319.1 |
| 8,277,002 | B2 * | 10/2012 | Perez et al. | 312/333 |
| 8,510,912 | B2 * | 8/2013 | Tarrega Lloret | 16/79 |
| 8,511,763 | B2 * | 8/2013 | Salice | 312/333 |
| 8,595,898 | B2 * | 12/2013 | Smith | 16/78 |
| 8,668,288 | B2 * | 3/2014 | Salice | 312/333 |

* cited by examiner

*Primary Examiner* — William Miller
(74) *Attorney, Agent, or Firm* — Lucas & Mercanti, LLP

(57) ABSTRACT

Self-closure device for sliding mobile parts, comprising an integrator element with three active areas—one front area that forms the first area or activator latch area, which swings, a second area or flexion area, which, given the elasticity of the material, enables the activator latch to swing and a third area or guide area, which guides the translation of the device and links it to the energy accumulator and the dampener.

4 Claims, 3 Drawing Sheets

SELF-CLOSURE DEVICE FOR SLIDING MOBILE PARTS

CROSS-REFERENCE TO RELATED APPLICATIONS

This application claims the priority of Spanish Application no. ES 201330007 filed Jan. 8, 2013, the contents of which are incorporated herein by reference.

FIELD OF THE INVENTION

The present invention relates to a self-closure device for sliding mobile parts, of the variety that have a built in drive element, an energy accumulator or spring and a dampener. It is particularly applicable to the closure of sliding doors.

PREVIOUS STATE OF THE ART

Self-closure devices for sliding mobile parts such as sliding drawers and/or doors are known about in this field.

The first means of assisting closure in drawers were based on making a recess in the drawer guides alone, thus enabling the wheels of the drawer to drop as a result of their own weight when they reached this recessed point, thereby closing the drawer in the last leg of its journey. This type of system did not ensure that the drawer was closed properly given that it was necessary for the same to be pushed to almost the end of the track and in addition, owing to the recesses, the drawers were heavy (for example those used in kitchen fittings), which meant that the wheels made noises which bothered users when they came down into the recesses.

Another type of self-closure intended to ensure correct closure of the drawer if the same did not reach the end position had a spring and a latch linked to a coupling in the drawer. When it was moved towards its open position, the spring was tensed and fixed by means of the latch and as it moved back, the latch let of its fixed position, thus freeing the energy accumulated in the spring, which moved the drawer to its end closed position. Nevertheless, this device composition gave rise to a bothersome bump when the drawer reached closed position.

Devices with an activation latch are also known about, these latches being linked directly to the dampener and spring. However, when the latch reached the maximum end position in these devices with an activation latch, it was necessary to include a piece, which acting alongside said latch, resolved said problem, this piece being referred to as sliding and enabling the drive element to occupy the desired end position.

Nowadays, it is very common to find self-closure devices which have a built in latch, activator, a spring, a spool and a dampener on the market. Incorporating the dampener makes it possible for the force exerted by the spring when it contracts to be absorbed by the same in the final stretch of the drawers journey, thereby facilitating gently, progressive closure thereof.

EXPLANATION AND ADVANTAGES OF THE INVENTION

Within the context of this state of affairs, the present invention refers to a self-closure device for sliding mobile parts, which comprises an energy accumulator device that is charged with the movement of opening the piece of furniture, an activator latch that interacts with the drive element, an activator latch that locks the energy accumulator in its open position and a dampener, by means of which before arriving at a closed position, a counter force is generated, thus absorbing the energy of the energy accumulator device when the first area or activator latch area is uncoupled from its locked position, wherein there is an integrator element with three active areas—one front area that forms the first area or activator latch (2*a*) area, which swings, a second area or flexion area (2*b*), which enables the activator latch (2*a*) to swing as a result of the elasticity of the material it is made from and a third area or guided zone, which guides the translation of the device and links it to the energy accumulator and to the dampener.

This formation results in a mechanism in which the traditional activator latch and spool composition is substituted by one single piece, thus reducing manufacturing materials in comparison to the double conjunction, also making it easier to mount the same.

The invention is also unique in that the first area or activator latch area has at least one revolving pin linked to the guide channel and at least one locking peg linked to the support locking channel.

The invention is additionally unique in that the support has guide taps, guide channels and locking channels in both the front and rear portions thereof.

This double guide formation at both sides of the support means that the device is able to ensure that the course is completed perfectly in cases where it was necessary to use it in sliding doors for large wardrobes.

Finally, the invention is unique in that the drive element is usually located in the sliding mobile part and the self-closure device in the non-mobile part of the furniture, this position being clearly interchangeable should a certain application so require.

This interchangeable quality makes it possible to produce a very versatile device that may be adapted to the formation required by the piece of furniture for installation, it being possible for both the self-closure device and the drive element to make relative longitudinal journeys during opening and closure.

These unique qualities, amongst others, shall be shown more clearly in the detailed explanation below, which is based on the attached graphical representations.

DRAWINGS AND REFERENCES

In order to better understand the nature of the invention, the attached drawings represent an industrial embodiment of the same, which serves as a non-limiting example thereof.

1.—Self-closure device.
2.—Integrator element.
2*a*..—First area or activator latch area.
2*b*..—Second area or flexion area.
2*c*..—Third area or guide area.
2*d*..—Revolving pin.
2*e*..—Locking pin.
2*f*..—Recess.
3.—Energy accumulator.
3*a*..—Energy accumulator link (3).
4.—Dampener.
4*a*..—Dampener link (4).
5.—Support.
5*a*..—Guide tab.
5*b*..—Guide channel.
5*c*..—Locking channel.
5*d*..—Front part of the support (5).
5*e*..—Rear part of the support (5).
6.—Closure elements.
7.—Drive element.

PREFERRED EMBODIMENT OF THE INVENTION

Figure 1:
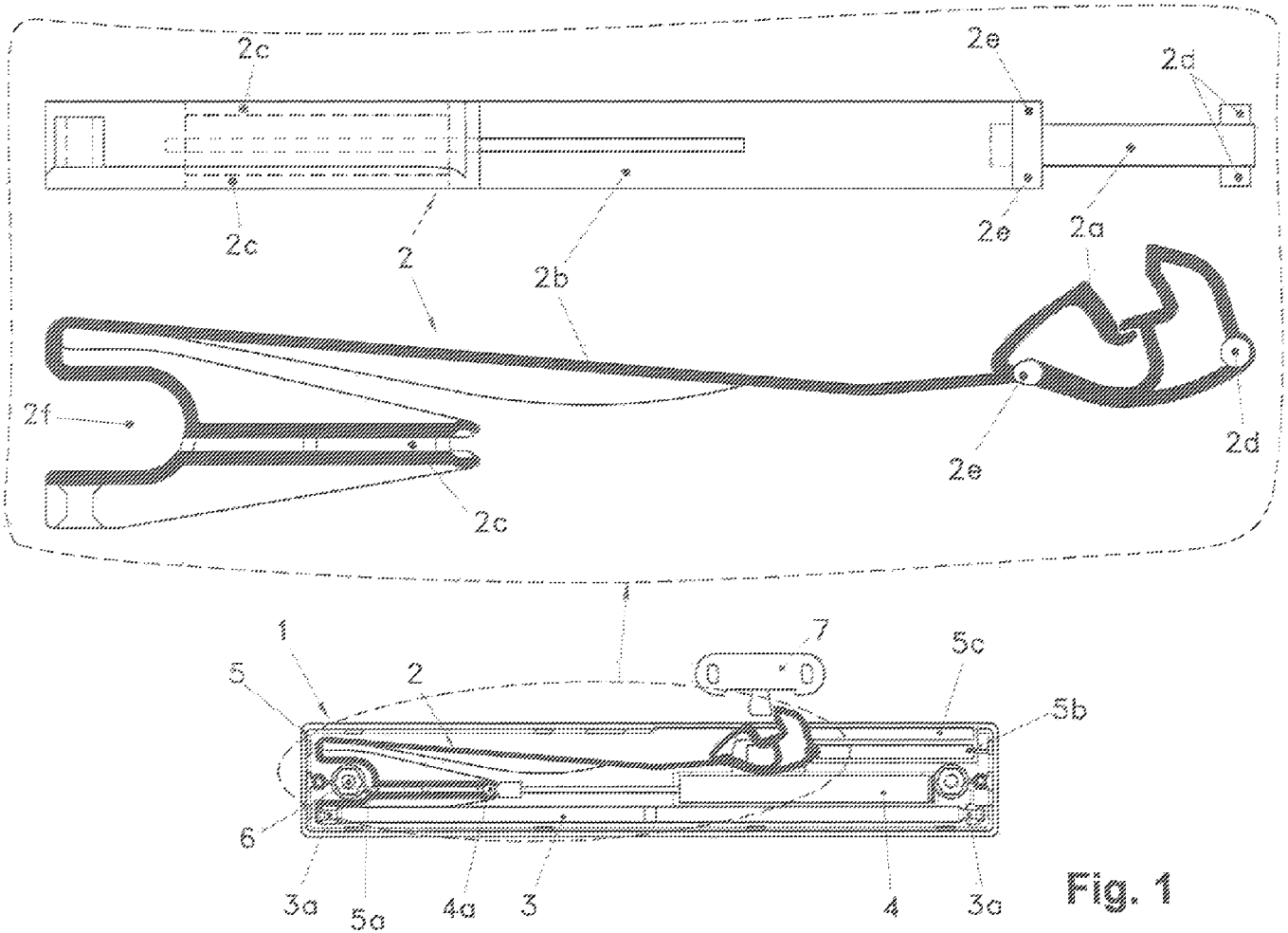
FIG. 1 is an elevation view showing the self-closure device (1) in open position, wherein the first area or activator latch area (2*a*) is blocked, the integrator element (2), the energy accumulator (3) and the dampener (4), an amplified view of the different areas and the integrator element (2) component being built into the same.

Self-closure device (1) for sliding mobile parts, comprising an energy accumulator device (3), which is charged with the opening movement of the piece of furniture, a first area or activator latch (2*a*) area, that interacts with the drive element (7), an activator latch (2*a*), which locks the energy accumulator device (3) in open position and a dampener (4), by means of which a counter force is generated, absorbing the energy from the accumulator device (3) before closed position is reached, when the first area or activator latch (2*a*) area is uncoupled from locking position. FIG. 1 represents the object of the invention, which consists of an integrator element (2) with three active areas—one front area that forms the first area or activator latch (2*a*) area, which swings, a second area or flexion area (2*b*), which enables the activator latch (2*a*) to swing as a result of the elasticity of the material from which it is made and a third area or guide area (2*c*), which guides the translation of the device and links it to the energy accumulator (3) and dampener (4).

Figure 2:
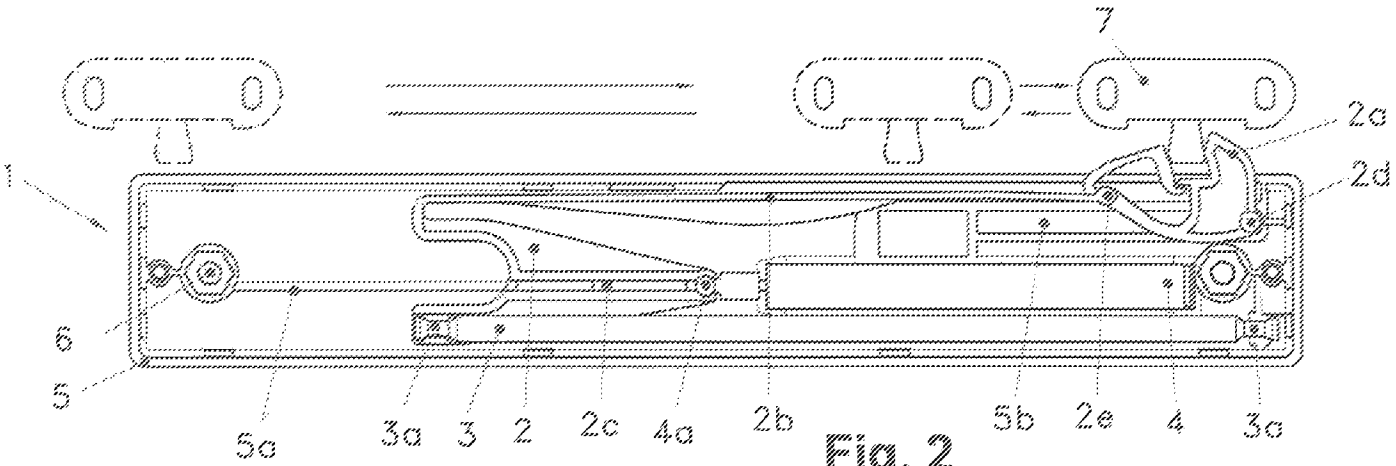
FIG. 2 is an elevation view showing the self-closure device (1) in closed position, wherein the first area or activator latch (2*a*) area is unblocked, it being possible to observe the relative movements that the drive element (7) is able to make in relation to the self-closure device (1) during opening and closure.
Figure 3:
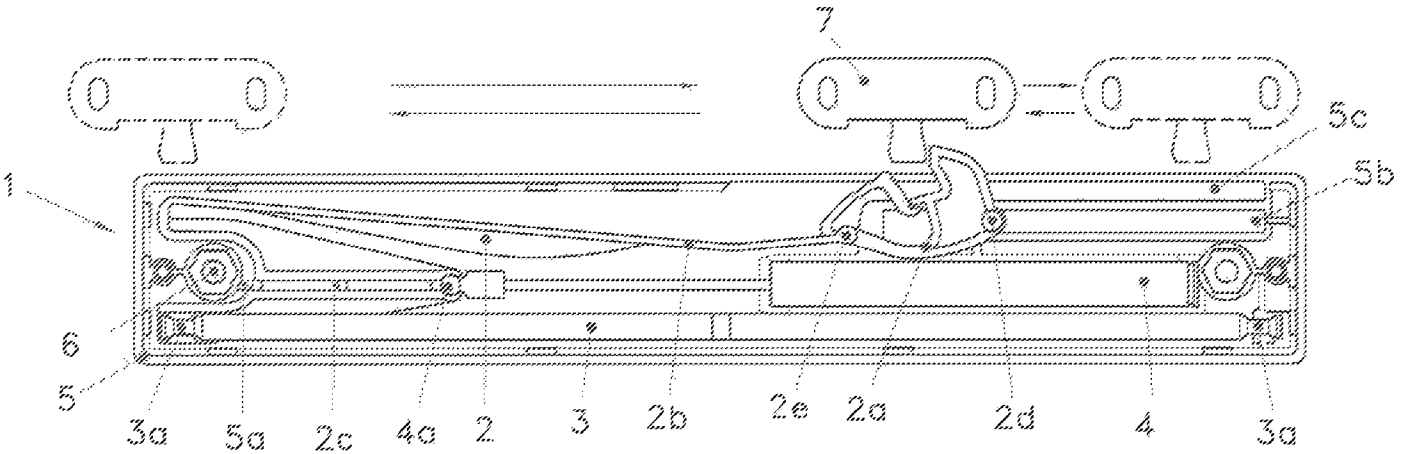
FIG. 3 is an elevation view of the self-closure device (1) in open position, wherein the first area or activator latch (2*a*) area is in locked position, it being possible to observe the relative movements the drive element (7) is able to make in relation to the self-closure device (1) during opening and closure.

The simple construction of the invention and the face that it is easy to be mount can be seen in FIGS. 1, 2 and 3, wherein it is possible to observe that the self-closure device (1) may be mounted easily, it also being possible to observe the reduction in material brought about by the integrator element (2) being used, this element (2) being included in one single piece in the first area or activator latch (2*a*), a second area or flexion area that facilitates the flexion of the activator latch (2*a*) and a third area or guide area (2*c*) which serves as a guide for displacement, in addition to linking the integrator element (2) to the energy accumulator (3) and the dampener (4).

Another characteristic of the invention, which can be seen in FIG. 2, is that the first area of activator latch (2*a*) area has at least one revolving pin (2*d*) linked to the guide channel (5*b*) and at least one locking pin (2*e*) linked to the locking channel (5*c*) of the support (5).

Figure 4:
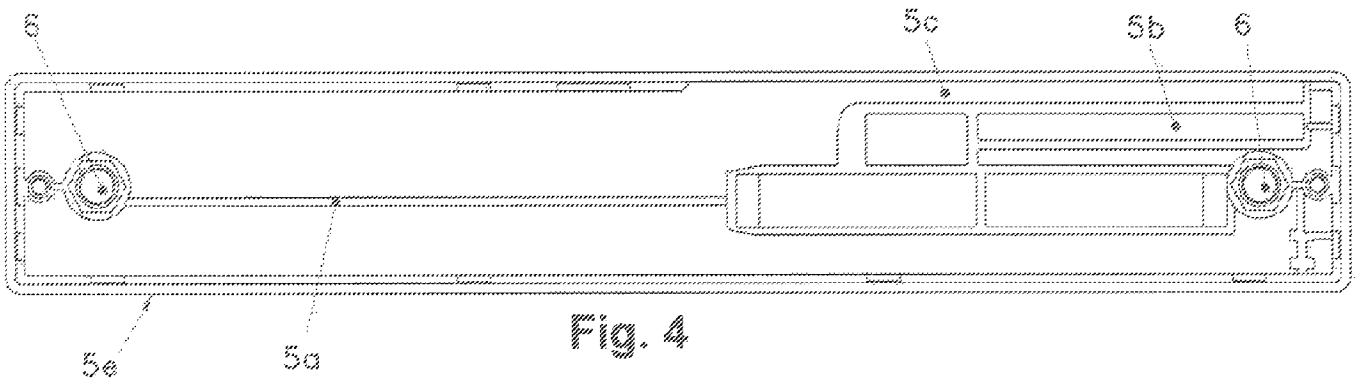
FIG. 4 is an elevation view of the rear part (5*e*) of the support (5).
Figure 5:
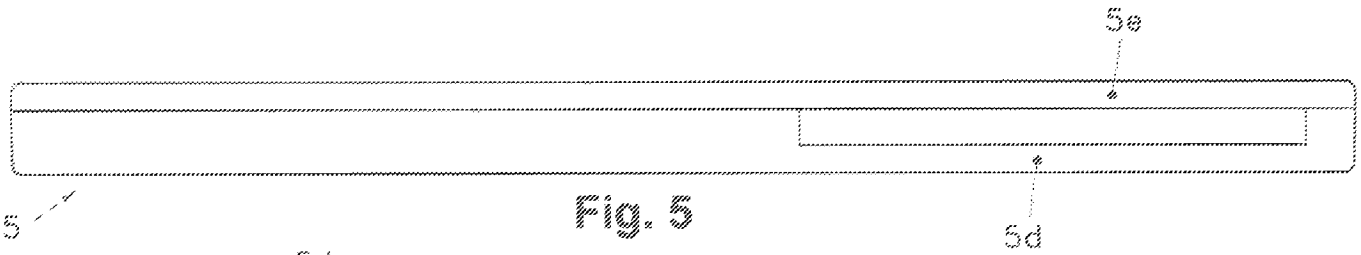
FIG. 5 is a plan view of the support (5), wherein the front part (5*d*) and the rear part (5*e*) are mounted.
Figure 6:
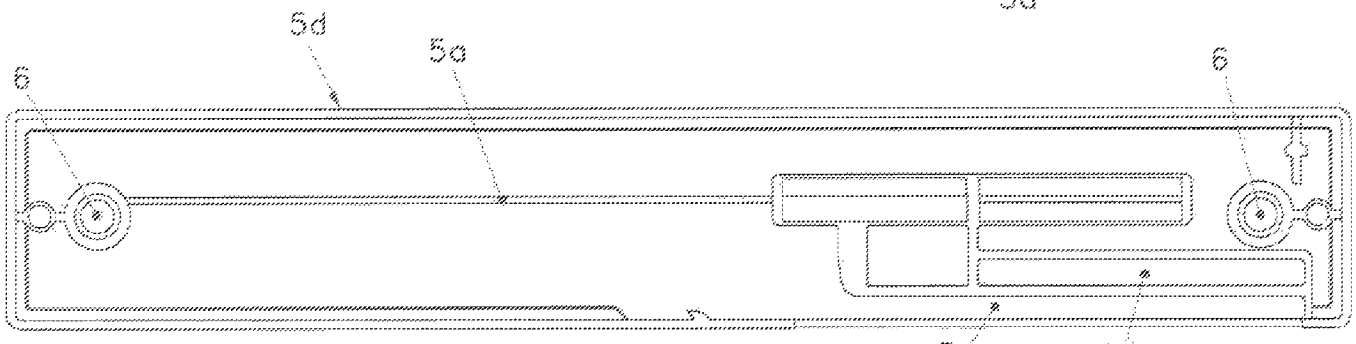
FIG. 6 is an elevation view of the front part (5*d*) of the support (5).

A further characteristic of the invention, as can be seen in FIGS. 4 and 5, is that the support (5) has guide tabs (5*a*), guide channels (5*b*) and locking channels (5*c*) in both the front (5*d*) and rear (5*e*) parts.

This double guide formation at both sides of the support (5*d*, 5*e*) makes it possible for the self-closure device (1) to ensure the course is completed perfectly in the correct embodiment, in cases when it was necessary to use it in heavier drawers.

Another characteristic of the invention, as can be seen in FIGS. 2 and 3, is that the drive element (7) is usually located in the sliding mobile part and the self-closure device (1) in the non-mobile part of the piece of furniture, this position being clearly interchangeable should a certain application so require.

This interchangeable quality makes it possible to produce a very versatile device according to the formation required by the piece of furniture for installation, it being possible for both the self-closure device (1) and the drive element (7) to make the relative longitudinal journeys during opening and closure. In this case, as can be observed in FIGS. 2 and 3, the element that remains fixed is the self-closure device, whilst the drive element (7) occupies various positions along the length of its longitudinal opening and closure trajectory.

Variations in material, form, size and arrangements of the component elements do not alter the essence of this invention, described in a non-limiting fashion, in such a way that it may now be reproduced by an expert.

The invention claimed is:

1. A self-closure device for sliding mobile parts, comprising:
- an energy accumulator device adapted to absorb first energy from a movement of a sliding mobile part of a piece of furniture, when the sliding mobile part is being opened; and
- a dampener adapted to generate a counter force in response to the movement of the sliding mobile part, the dampener being further adapted to absorb second energy from the energy accumulator device when the sliding mobile part is being closed, before the sliding mobile part reaches a closed position;
- an integrator element comprising:
  - a first portion comprising an activator trigger, the activator trigger:
    - engaging a drive element disposed on the sliding mobile part,
    - moving from an uncoupled position to a locked position in response to contact with the drive element, and
    - locking the energy accumulator device in an open position when the activator trigger is in the locked position;
  - a second portion comprising an elastic material that enables the first portion to move from the uncoupled position to the locked position; and
  - a third portion coupled to the energy accumulator and the dampener and serving as a translation guide for the self-closure device.

2. The self-closure device for sliding mobile parts according to claim 1, further comprising:
- a support comprising at least one guide channel and at least one locking channel;
- wherein the first portion has at least one rotating pin linked to the at least one guide channel and at least one locking pin linked to the at least one locking channel.

3. The self-closure device for sliding mobile parts according to claim 2, wherein the support has a front part and a rear part;
- wherein the at least one guide channel includes a first guide channel and a second guide channel;

wherein the at least one locking channel includes a first locking channel and a second locking channel; and wherein the front part of the support comprises one or more first guide tabs, the first guide channel and the first locking channel and wherein the rear part of the support comprises one or more second guide tabs, the second guide channel and the second locking channel.

4. The self-closure device for sliding mobile parts, according to claim 1, wherein the self-closure device is disposed on a second part of the piece of furniture different from the sliding mobile part, in a manner that renders the self-closure device readily detachable and replaceable.

* * * * *